US007823508B2

(12) United States Patent
Anderson et al.

(10) Patent No.: US 7,823,508 B2
(45) Date of Patent: Nov. 2, 2010

(54) CONNECTOR FOR DETONATOR, CORRESPONDING BOOSTER ASSEMBLY, AND METHOD OF USE

(75) Inventors: David Geoffrey Anderson, St. Eugene (CA); Jan Mark Brochocki, Lachute (CA); Peter Thomas Husk, Hawkesbury (CA); Christine Geneviève Pierrette Quesnel, Lachute (CA)

(73) Assignee: Orica Explosives Technology Pty Ltd, Melbourne, Victoria (AU)

( * ) Notice: Subject to any disclaimer, the term of this patent is extended or adjusted under 35 U.S.C. 154(b) by 569 days.

(21) Appl. No.: 11/843,806

(22) Filed: Aug. 23, 2007

(65) Prior Publication Data

US 2008/0173204 A1 Jul. 24, 2008

Related U.S. Application Data

(60) Provisional application No. 60/839,669, filed on Aug. 24, 2006.

(51) Int. Cl.
*F42B 3/02* (2006.01)
*F42B 3/10* (2006.01)

(52) U.S. Cl. ..... 102/318; 102/202.12; 102/202.14; 102/275.12

(58) Field of Classification Search . 102/275.9–275.12, 102/202.12, 202.14, 318, 204
See application file for complete search history.

(56) References Cited

U.S. PATENT DOCUMENTS

| | | | | |
|---|---|---|---|---|
| 3,356,024 | A | 12/1967 | Driscoll et al. | |
| 3,661,085 | A | 5/1972 | Smith et al. | |
| 4,023,493 | A | 5/1977 | Austin et al. | |
| 4,147,108 | A | 4/1979 | Gore et al. | |
| 4,289,072 | A * | 9/1981 | Edgell et al. | 102/318 |
| 4,354,432 | A | 10/1982 | Cannavo et al. | |
| 4,383,484 | A * | 5/1983 | Morrey | 102/275.3 |
| 4,425,849 | A * | 1/1984 | Jorgenson | 102/275.12 |
| 4,481,884 | A * | 11/1984 | Yunan | 102/313 |
| 4,485,741 | A * | 12/1984 | Moore et al. | 102/331 |
| 5,327,835 | A * | 7/1994 | Adams et al. | 102/275.11 |
| 5,417,162 | A * | 5/1995 | Adams et al. | 102/317 |
| 5,501,151 | A * | 3/1996 | Thureson et al. | 102/275.7 |
| 5,573,428 | A | 11/1996 | Biggs et al. | |
| 5,631,440 | A * | 5/1997 | Thureson et al. | 102/275.7 |
| 5,641,941 | A | 6/1997 | Dieman, Jr. et al. | |
| 5,714,712 | A * | 2/1998 | Ewick et al. | 102/311 |
| 5,988,069 | A * | 11/1999 | Bailey | 102/202.9 |
| 6,508,176 | B1 * | 1/2003 | Badger et al. | 102/275.7 |
| 6,662,727 | B2 * | 12/2003 | Bornheim et al. | 102/530 |
| 6,739,265 | B1 * | 5/2004 | Badger et al. | 102/275.3 |
| 6,880,465 | B2 * | 4/2005 | Badger et al. | 102/275.7 |
| 7,343,859 | B2 * | 3/2008 | Matsuda et al. | 102/217 |
| 2005/0016409 | A1 * | 1/2005 | Husk et al. | 102/275.7 |

FOREIGN PATENT DOCUMENTS

| | | |
|---|---|---|
| CA | 2147521 | 10/1995 |
| DE | 29 45 803 A1 | 5/1981 |
| RU | 2 150 671 C1 | 6/2000 |

* cited by examiner

*Primary Examiner*—Bret Hayes
*Assistant Examiner*—Michael D David

(57) ABSTRACT

Mining operations frequently involve the use of electric or electronic delay detonators in operative association with an explosive charge contained in a booster. Disclosed herein are connectors for connecting a signal transmission line to a detonator associated with a booster. In this way, the connectors, at least in preferred embodiments, allow the production of a substantially sealed booster assembly having a secure electrical connection to a signal transmission line. Also disclosed are methods of producing substantially sealed booster assemblies, and methods for their use in mining operations.

13 Claims, 10 Drawing Sheets

CONNECTOR FOR DETONATOR, CORRESPONDING BOOSTER ASSEMBLY, AND METHOD OF USE

CROSS-REFERENCE TO RELATED APPLICATION

This application claims the priority right of prior U.S. patent application 60/839,669 filed Aug. 24, 2006 by applicants herein.

FIELD OF THE INVENTION

The present invention relates to the field of blasting for mining operations. More specifically, the invention relates to electrical connection of detonators and associated boosters to other components of the blasting apparatus.

BACKGROUND TO THE INVENTION

A blasting apparatus may typically comprise an array of detonators and associated explosive charges, connected via wire signal transmission lines (e.g. branch lines and trunk lines) to one or more associated blasting machines. The detonators may receive a command signal to FIRE through the signal transmission lines. In the case of electronic detonators, the command signals may further include more complex instructions including, but not limited to, signals to ARM, DISARM, ACTIVATE, DEACTIVE, or SHUTDOWN the detonator, or may include firing codes or delay times.

Often, detonators are positioned at a blast site in operative association with a booster. Typically, a booster may comprise a discrete portion of explosive material retained or partially retained within a cup-like member or within a suitable recess. During use at a blast site, a detonator, or more particularly a percussion-actuation end of a detonator comprising a small base charge, may be positioned adjacent the explosive material in the booster. Successful receipt by the detonator of a command signal to FIRE may result in the initiation of the detonator's base charge, which in turn causes actuation of the explosive material of the booster. If required, the booster may be in operable association with further explosive material such as a cross-linkable explosive emulsion, for example positioned down a borehole in rock, such that actuation of the booster in turn causes actuation of the further explosive material, causing more powerful shockwaves for rock fragmentation.

The integrity of the connections between the detonators and an associated blasting machine is paramount. Poor connections may result in detonator failure during a blasting event, for example due to improper transmission and receipt of command signals by the detonators. Detonators that fail to actuate in response to a command signal to FIRE present a significant safety concern at the blast site. Retrieval of such failed detonators, and their associated explosive charges, may present a hazardous process.

Proper establishment of a blasting apparatus at a blast site requires positioning of detonators and associated boosters at desired positions in the rock, and "tieing-in" of the detonators to at least one corresponding blasting machine. This "tieing-in" process is labour intensive and required considerable skill and diligence of the blast operator. The blast operator must ensure that detonators are properly associated with boosters at each position in the rock, lay trailing wires from each detonator to a corresponding blasting machine, and ensure that the electrical connections between each detonator and each trailing wire, as well as each trailing wire and each blasting machine, are properly established.

In other blasting apparatuses known in the art, detonators are manufactured and shipped with trailing wires already secured therein. Whilst this avoids the need to "tie-in" the detonators to the trailing wires at the blast site, shipment and usage of such preassembled detonator/trailing wire combinations can be problematic. Numerous wire strength/length combinations must be manufactured and available for the consumer, resulting in higher manufacturing costs. Moreover, due to the presence of small quantities of explosive material, detonators must be shipped and handled carefully in accordance with strict regulations. Preassembly and shipment of detonators with attached trailing wires can significantly increase the cost and logistics of the shipment process.

There remains a continuing need to develop blasting apparatuses, and components thereof, which permit rapid and reliable establishment of the blasting apparatus at the blast site. In particular, there is a need for blasting apparatus components that enable hazardous components of the blasting apparatus to be separately shipped to a blast site, and assembled with non-hazardous components quickly and easily. In particular, there is a need for a blasting apparatus in which booster components and detonator components may be separately shipped to a blast site, and assembled without significant difficulty into a robust and reliable booster assembly.

SUMMARY OF THE INVENTION

It is an object of the invention, at least in preferred embodiments, to provide a detonator or detonator/booster combination comprising means for improved connectivity to an associated signal transmission line.

It is another object of the invention, at least in preferred embodiments, to provide a blasting apparatus component that facilitates connection between at least two of a signal transmission line, a detonator, and a booster.

It is another object of the invention, at least in preferred embodiments, to provide a booster assembly comprising a detonator that is substantially sealed to prevent ingress of water or dirt at the blast site.

Certain exemplary embodiments provide a booster assembly comprising:

(1) a detonator comprising a percussion-actuation end comprising a base charge, and a connection end opposite the percussion-actuation end comprising at least one connection point;

(2) a booster comprising a booster housing, an explosive charge retained or partially retained by the booster housing, and a detonator positioning means to position the detonator in the booster housing such that receipt by the detonator via a signal transmission line of a command signal to FIRE causes initiation of the base charge, and subsequent actuation of the explosive charge in the booster; and (3) a connector for securing the signal transmission line in electrical connection with the detonator positioned in the booster, the connector comprising:

a) an attachment cap for permanently or selectively sealing the connector to the booster housing, optionally by way of a deformable seal at an interface between said booster housing and said connector when said connector is secured to said booster housing to cause: frictional engagement to assist in securing said connector to said booster housing and/or to substantially prevent ingress of dirt or water into said housing at said interface; and b) a signal transmission line retainer extending through the attachment cap for holding the signal transmission line in secure electrical contact with the at least one connection point of the detonator when the attachment cap is secured to the booster housing, an interface between said retainer and said signal transmission line and/or said attachment cap being at least substantially sealed. The retainer may grip the signal transmission line.

Certain exemplary embodiments provide a connector for securing a signal transmission line in electrical connection with a detonator positioned in a booster, the detonator having a percussion-actuation end comprising a base charge, and a connection end opposite the percussion-actuation end comprising at least one connection point, the booster comprising a booster housing, an explosive charge retained or partially retained by the booster housing, and a detonator positioning means to position the detonator in the booster housing such that receipt by the detonator via the signal transmission line of a command signal to FIRE causes initiation of the base charge, and subsequent actuation of the explosive charge in the booster, the connector comprising:

an attachment cap for permanently or selectively sealing the connector to the booster housing, optionally by way of a deformable seal at an interface between said booster housing and said connector when said connector is secured to said booster housing to cause: frictional engagement to assist in securing said connector to said booster housing and/or to substantially prevent ingress of dirt or water into said housing at said interface; and a signal transmission line retainer extending through the attachment cap for holding the signal transmission line in secure electrical contact with the at least one connection point of the detonator when the attachment cap is secured to the booster housing, an interface between said retainer and said signal transmission line and/or said attachment cap being at least substantially sealed. The retainer may grip the signal transmission line.

Certain exemplary embodiments provide a detonator for use in connection with the booster assembly of the invention, the detonator comprising:

a shell with a percussion-actuation end and a signal receiving end;

a base charge positioned at or adjacent the percussion-actuation end;

electronic command signal receiving and processing means located within said shell, for receiving an processing at least one electronic command signal received from another component of the blasting apparatus; and at least one pin and/or at least one socket at said signal receiving end, for electrical connection of said electronic command signal receiving and processing means with said other component of the blasting apparatus, each pin or socket comprising electrically conductive material.

Certain exemplary embodiments provide a blasting apparatus for conducting a blasting event at a blast site, the blasting apparatus comprising;

at least one blasting machine for generating command signals;

at least one booster assembly of the invention each in signal communication with said at least one blasting machine via a signal transmission line.

Certain exemplary embodiments provide a method of producing a booster assembly of the invention, comprising the steps of:

providing a detonator comprising a percussion-actuation end comprising a base charge, and a connection end opposite the percussion-actuation end comprising at least one connection point;

providing a booster comprising a booster housing, a portion of explosive material retained or partially retained by the booster housing, and a detonator positioning means to position the detonator in the booster housing such that receipt by the detonator via the signal transmission line of a command signal to FIRE causes initiation of the base charge, and subsequent actuation of the explosive material in the booster; and attaching a connector of the invention to the booster housing.

Certain exemplary embodiments provide a method of conducting a blasting event at a blast site, comprising the steps of:

positioning at least one booster assembly of the invention at the blast site, optionally in operative association with an explosive charge;

connecting each of said at least one booster assembly via a signal transmission line to an associated blasting machine;

transmitting from each blasting machine a command signal to fire to said at least one booster assembly via each signal transmission line, thereby to effect actuation of each base charge of each detonator of each booster assembly, thereby to cause actuation of the explosive material in said booster, and actuation of said explosive charge, if present.

Certain exemplary embodiments provide a use of the connector of the invention for securing a signal transmission line to a booster, and optionally to prevent ingress of water and/or dirt into a booster assembly.

DEFINITIONS

Figure 1:
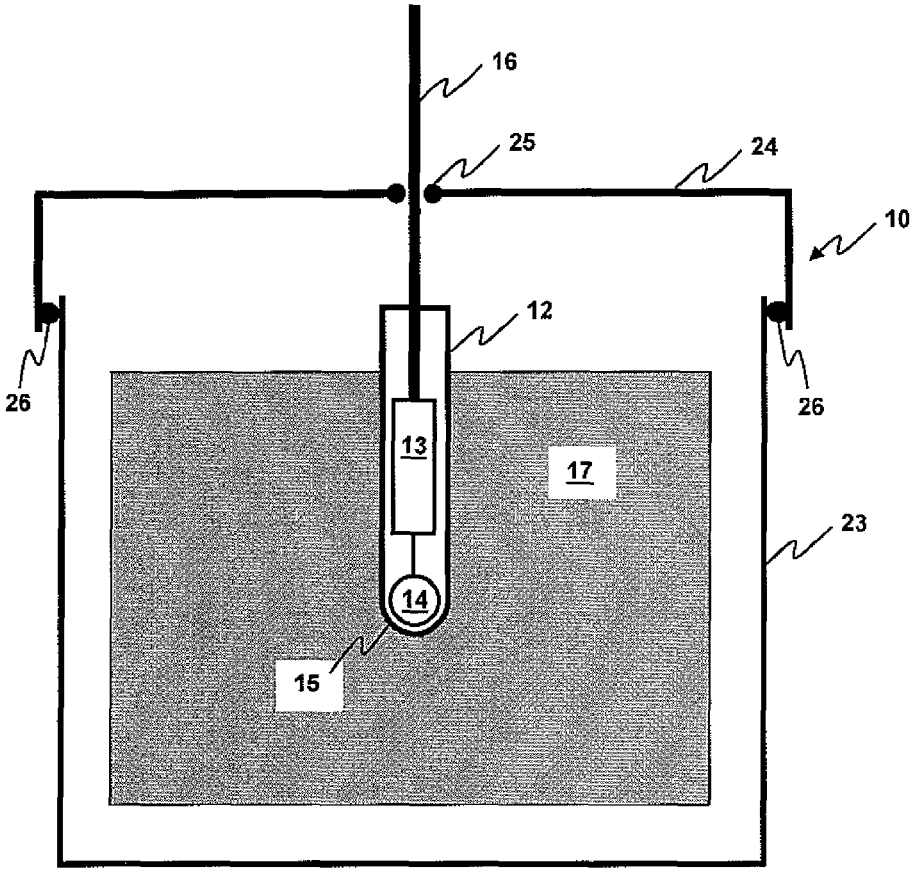
FIG. 1 schematically illustrates a preferred booster assembly of the invention, comprising a preferred connector of the invention in cross-section.

Attachment cap: refers to any member that partially or completely covers an opening or open side of a booster, thereby to help cover or protect explosive material in the booster. The attachment cap typically forms a part of a connector of the invention, and permits attachment of the connector to a booster housing, preferably to seal an interface between the connector and the booster housing. In most preferred embodiments, the attachment cap may take the form of a substantially disc-like or flattened member comprising an electrically insulating material such as a plastic or resin, shaped or configured about its entire periphery to engage or be attached to a booster housing, preferably having a substantially cylindrical configuration.

Base charge: refers to any discrete portion of explosive material in the proximity of other components of the detonator and associated with those components in a manner that allows the explosive material to actuate upon receipt of appropriate signals from the other components. The base charge may be retained within the main casing of a detonator, or alternatively may be located nearby the main casing of a detonator. The base charge may be used to deliver output power to an external explosives charge to initiate the external explosives charge.

Blasting machine: any device that is capable of being in signal communication with electronic detonators, for example to send ARM, DISARM, and FIRE signals to the detonators, and/or to program the detonators with delay times and/or firing codes. The blasting machine may also be capable of receiving information such as delay times or firing codes from the detonators directly, or this may be achieved via an intermediate device to collect detonator information and transfer the information to the blasting machine.

Booster: refers to any device comprising a housing (a booster housing) and, contained at least partly within the booster housing, an explosive charge, and preferably a position for seating a detonator such that the percussion-actuation end of the detonator is in operative association with the explosive charge. In this way, receipt by the detonator of an appropriate signal to FIRE may result in actuation of a base charge in the detonator at the percussion-actuation end, and actuation of the explosive charge in the booster. The booster may, at least in preferred embodiments, include means for permitting attachment and optionally sealing thereto of an attachment cap. A booster may take on any shape, size or configuration. Typically, thought not necessarily, a booster may be cylindrical in general shape, or at least have a circular cross-section or top.

Booster assembly: refers to a combination comprising a booster, a detonator, and a connector of the present invention, optionally together with a signal transmission line.

Central command station—any device that transmits signals via radio-transmission or by direct connection, to one or more blasting machines. The transmitted signals may be encoded, or encrypted. Typically, the central blasting station permits radio communication with multiple blasting machines from a location remote from the blast site.

Clock: encompasses any clock suitable for use in connection with a wireless detonator assembly and blasting system of the invention, for example to time delay times for detonator actuation during a blasting event. In particularly preferred embodiments, the term clock relates to a crystal clock, for example comprising an oscillating quartz crystal of the type that is well know, for example in conventional quartz watches and timing devices. Crystal clocks may provide particularly accurate timing in accordance with preferred aspects of the invention.

Connection point: refers to any type or form of electrical contact for a detonator with a signal transmission line or another component of a blasting apparatus such as an electrically conductive bridge element of a connector of the present invention. In preferred embodiments, a connection point may involve a pin and socket-type arrangement.

Electrically conductive bridge element/bridge element: refers to any portion of electrically conductive material (e.g. a metal) adapted to extend through an attachment cap of a connector of the present invention, configured or otherwise adapted to be suitable to establish electrical contact for example between a signal transmission line and a detonator or a component thereof.

Explosive charge: includes a discreet portion of an explosive substance contained or substantially contained within a booster. The explosive charge is typically of a form and sufficient size to receive energy derived from the actuation of a base charge of a detonator, thereby to cause ignition of the explosive charge. Where the explosive charge is located adjacent or near to a further quantity of explosive material, such as for example explosive material charged into a borehole in rock, then the ignition of the explosive charge may, under certain circumstances, be sufficient to cause ignition of the entire quantity of explosive material, thereby to cause blasting of the rock. The chemical constitution of the explosive charge may take any form that is known in the art, most preferably the explosive charge may comprise TNT or pentolite.

Explosive material: refers to any quantity and type of explosive material that is located outside of a booster or booster assembly of the present invention, but which is in operable association with the booster, such that ignition of the explosive charge within the booster causes subsequent ignition of the explosive material. For example, the explosive material may be located or positioned down a borehole in the rock, and a booster may be located in operative association with the explosive material down or near to the borehole. In preferred embodiments the explosive material may comprise pentolite, TNT, or an explosive emulsion composition.

Logger/Logging device: includes any device suitable for recording information with regard to a booster of the present invention, or a detonator contained therein. The logger may transmit or receive information to or from a booster of the invention or components thereof. For example, the logger may transmit data to a booster such as, but not limited to, booster identification codes, delay times, synchronization signals, firing codes, positional data etc. Moreover, the logger may receive information from a booster including but not limited to, booster identification codes, firing codes, delay times, information regarding the environment or status of the booster, information regarding the capacity of the booster to communicate with an associated blasting machine (e.g. through rock communications). Preferably, the logging device may also record additional information such as, for example, identification codes for each detonator, information regarding the environment of the detonator, the nature of the explosive charge in connection with the detonator etc. In selected embodiments, a logging device may form an integral part of a blasting machine, or alternatively may pertain to a distinct device such as for example, a portable programmable unit comprising memory means for storing data relating to each detonator, and preferably means to transfer this data to a central command station or one or more blasting machines. One principal function of the logging device, is to read the booster so that the booster or detonator contained therein can be "found" by an associated blasting machine, and have commands such as FIRE commands directed to it as appropriate. A logger may communicate with a booster either by direct electrical connection (interface) or a wireless connection of any type known in the art, such as for example short range RF, infrared, Bluetooth etc.

Pin/pin element: refers to any portion of electrically conductive material typically shaped as a projection and sized to be received and to make electrical contact with a socket or socket element, thereby to establish electrical contact between components of the booster assembly of the invention.

Preferably: identifies preferred features of the invention. Unless otherwise specified, the term preferably refers to preferred features of the broadest embodiments of the invention, as defined for example by the independent claims, and other inventions disclosed herein.

Seal: refers to any means for close or forced contact between two components of a booster assembly of the invention, or a component of a booster assembly of the invention and a signal transmission line. A seal may take any form suitable to substantially prevent passage between the components (or the signal transmission line and a component) of water and/or dirt. Such seals may include, but are not limited to, a precision fit, a friction fit, a deformable seal (e.g. comprising an elastic material), an O-ring, an interference fit etc.

Sensitizing insert: refers to any discrete portion of explosive material intended for positioning in a booster, so that insertion of a detonator into the booster, and actuation of a base charge in the detonator, causes actuation of the sensitizing insert, and subsequent actuation of a larger explosive charge in the booster. In this way, the sensitizing insert forms an intermediary explosive charge between the base charge of the detonator and the larger explosive charge in the booster. The sensitizing insert may comprise any explosive material including but not limited to lead azide and/or PTN. In preferred embodiments, the sensitizing insert may be suitable for shipment with a corresponding booster (either integrated into the booster for shipment, or packaged separately). The sensitizing insert may allow for the booster assembly, once assembled, to be actuated using a lower power detonator when compared with a booster assembly lacking a sensitizing insert. Further, the use of such lower power booster assemblies may simplify the logistics of detonator transportation since lower power detonators may be subject to less stringent shipping requirements.

Signal transmission line: refers to any wired connection or line that is able to accept and transmit at least one electronic signal such as a command signal to FIRE from a blasting machine to a detonator. A signal transmission line, in selected embodiments, may also be able to transmit signal from a detonator back to a blasting machine. The signal transmission line may be manufactured and shipped for attachment to a detonator or another component of the blasting apparatus such as an attachment cap. Alternatively, the signal transmission line may be factory assembled attached to a detonator or attachment cap or other component.

Signal transmission line retainer/retainer: refers to any means for fixing or helping to attach a signal transmission line to a connector of the invention. Typically, the retainer will extend at least partially through an attachment cap of the invention. In a simple form, a retainer may take the form of an opening or orifice sized for passage therethrough of a signal transmission line, and retention of the signal transmission line by for example a precision fit, a friction fit, a seal such as an O-ring etc. In other embodiments of the connectors of the invention, the retainer may take the form of at least one electrically conductive bridge element extending through the orifice in the attachment cap, adapted for electrical contact with the connector at one end, and electrical contact with a wire of a signal transmission line at another end. The retainer may further include a seal or a reinforced portion of the attachment cap for secure retention therethough of the at least one bridge element.

Socket/socket element: refers to any portion of electrically conductive material typically shaped as a recess and sized to receive and to make electrical contact with a pin or pin element, thereby to establish electrical contact between components of the booster assembly of the invention.

DETAILED DESCRIPTION OF THE PREFERRED EMBODIMENTS

For any blasting event, components of a blasting apparatus must be transported to a blast site, and carefully brought into operable, reliable association with one another. This process requires considerable logistics, planning, and care to optimize the safety of those persons transporting and/or handling such components. Disclosed herein are means to improve the usability and connectivity of blasting components. Whilst these improvements relate to relatively simple mechanical features of the components, the implications and advantages are significant and far-reaching. The present invention not only improves the safety of the blasting apparatus, but in preferred embodiments also facilitates the logistics of transportation and set-up of blasting components prior to a blasting event.

As discussed, detonators are often factory assembled and transported to a blast site with signal transmission lines extending from a non-percussion actuation end. In this way, the detonators can be inserted into a suitable recess or socket of a booster positioned as required at the blast site, thereby to bring the percussion-actuation end of the detonator into operable association with an explosive charge within the booster. Likewise, the signal transmission line may be trailed across the blast site, and the other end of the signal transmission line (not attached to the detonator) may be connected to a blasting machine suitably positioned away from the danger of the blast.

The inventors have recognized the difficulties of establishing a booster/detonator combination at a blast site, and connecting such a combination via a signal transmission line to an associated blasting machine. The boosters of the prior art, regardless of association with a detonator, sometimes are prone to malfunction due to the ingress of water and/or dirt before, or even during, a blasting event. In selected embodiments, the present invention seeks to address such safety concerns by providing a booster or booster assembly that is substantially sealed to help prevent ingress of water or dirt. For this purpose, a connector is provided that may be attached to the booster housing. The connector includes an attachment cap with a seal positioned to seal an interface with the booster housing when the connector is attached to the booster. In addition, the connector includes a signal transmission line retainer extending through the attachment cap for gripping the signal transmission line, and holding the signal transmission line in secure electrical contact with a detonator positioned in the booster. Regardless of the configuration of the signal transmission line or signal transmission line retainer, the interference between the signal transmission line and the signal transmission line retainer may be sealed against ingress of water and/or dirt. In this way the booster/detonator combination is sealed (or at least substantially sealed) during establishment and execution of the blasting event.

Any form of engagement between the connector and the booster housing may be used in accordance with the connector and corresponding booster assemblies of the present invention. For example, the attachment cap of the connector may include a latched, lipped, stepped, threaded or bayonet portion to engage a correspondingly latched, lipped, stepped, threaded or bayonet portion of the booster housing, as will be described in more detail below with reference to the drawings. Moreover, the seal between the connector and the booster may also take any for including but not limited to a friction fit seal, a deformable seal made for example of an elastomeric material, a curable material or adhesive, a precision fit etc.

The invention encompasses connectors adapted for attachment of a signal transmission line directly to a detonator retained in a booster. For example, the attachment cap may include an orifice through which the signal transmission line may pass so that it may extend from a position outside the booster, through the connector, and into the booster for direct connection to the detonator. The detonator and signal transmission line may be factory assembled and shipped together, so that the signal transmission line is threaded through the connector at the blast site. If required, the signal transmission line may be further secured in position to seal the orifice in the attachment cap through the use of a seal such as a deformable seal made of an elastic material, a curable material or adhesive etc. Alternatively, the signal transmission line, detonator, and connector may be separately shipped to the blast site and assembled. In any event, such embodiments encompass a connector in which the signal transmission line retainer of the connector comprises at least the orifice of the attachment cap, the walls of which may be sufficient to provide a seal with the signal transmission line, optionally including a seal to seal the opening when the signal transmission line is appropriately positioned therethough.

In other embodiments of the invention, the connector may include a signal transmission line retainer in the form of at least one electrically conductive element extending through the attachment cap. In this way, the retainer effectively forms at least one electrically conductive bridge, wherein one end of each bridge is attached to a wire extending from a signal transmission line, the other end of each bridge makes electrical contact with at least one component of the detonator. Upon attachment of the connector to a booster containing a detonator, each bridge member is positioned to mate with or otherwise form electrical contact with a corresponding connection point of the detonator. Moreover, direct contact between the signal transmission line and the detonator is avoided, since the signal transmission line is attached outside of the booster on a side of the bridge extending exterior to the booster assembly when the attachment cap is in position. This presents a further advantage with regard to tugging forces on the signal transmission line, which are frequently experienced in the field. Previously, such tugging forces impacted directly upon the contacts (e.g. soldering joints) between the signal transmission line and the detonator, or internal components thereof. Breakage or other disruption of such contacts was not visibly obvious to the blast operator, causing inevitable safety concerns. However, in accordance with the present embodiments of the invention, the use of a connector comprising a retainer in the form of at least one electrically conductive bridge allows for signal transmission line connection at a visible location on an outside of the booster. In effect, the "weak-point" of the connection between the signal transmission line and the booster has been transferred from within the detonator to the bridge/transmission line interface, such as a wire crimp or clasp, located on an exterior of the booster housing. Such a connection can be more easily checked, and if necessary repaired, by a blast operator.

The use of electrically conductive bridge elements also facilitates sealing of the attachment cap, especially since the at least one bridge element may be inserted and sealed through the attachment cap during factory assembly of the connector. For example, if manufacturing tolerances are tight enough, the seal between the or each bridge element and the attachment cap may be achieved simply by the fit of the bridge element through the opening, or by way of a friction fit. Alternatively, a seal between the attachment cap and the at least one bridge element may be achieved by the use of a seal such as a deformable seal made for example of an elastic material, a curable material or adhesive etc.

The embodiments of the invention described above, which employ a signal transmission line retainer in the form of at least one electrically conducting bridge element, present still further advantages relating to the electrical contact of the bridge element with the detonator. Since the signal transmission line is secured to the connector, and the connector is secured to the booster housing, the nature of the connector/detonator electrical contact (via the bridge elements) need not necessarily be robust. It is also notable that the seal between the attachment cap and the booster housing, as well as the seal between the attachment housing and the signal transmission line retainer, substantially prevents ingress of water or dirt into the booster assembly, so that the bridge element/detonator electrical connections will not likely be disrupted by such materials during use. Therefore, the electrical contact between the bridge elements and the detonator may take any form suitable for transmission of electronic signals between the signal transmission line and the detonator.

In particularly preferred embodiments of the invention, the electrical contact between the detonator (positioned in the booster) and the at least one bridge element (when the connector is securely attached to the booster housing) may involve 'pin-and-socket' type arrangements, wherein each electrical contact involves a pin from either the bridge element or the detonator mating with a corresponding socket in an opposing position on either the bridge element or detonator. In one embodiment, the signal transmission line retainer may comprise one or more pins, and the detonator may comprise one or more sockets. Alternatively, the signal transmission line retainer may comprise one or more sockets, and the detonator may comprise one or more pins. Alternatively, the signal transmission line retainer may comprise one or more sockets and one or more pins, and the detonator may comprise one or more corresponding sockets and one or more corresponding pins, so that the sockets and pins are brought into a mating relationship when the connector is attached to the booster housing. In any event, the booster and/or the detonator may include one or more features to ensure that the attachment cap and detonator are oriented appropriately relative to one another so that mating between sockets and pins is successfully and readily achieved upon fitting the attachment cap to the booster/detonator combination. For example, such means may include, but it not limited to, the use of shaped elements or flanges on one or more of the connector, booster housing, and detonator seat within the booster, to ensure proper alignment.

The embodiments of the invention described above will be clarified, and further embodiments of the invention will become apparent, from a review of the various examples recited below, with cross-reference to the accompanying figures. Such examples merely illustrate preferred embodiments of the connector, booster assembly, and methods of the invention, and are in no way intended to limit the scope of the invention as defined by the accompanying claims:

EXAMPLES

Example 1

Booster Assembly Comprising Connector, with Signal Transmission Line Connected Directly to Detonator With reference to FIG. 1, there is illustrated a booster assembly shown generally at 10 comprising a connector, a booster and a detonator. The detonator 12 comprises a shell within which are internal electronic components 13 and a base charge 14 adjacent a percussion actuation end 15. A signal transmission line 16 is connected directly to the detonator, and specifically the internal components 13, via an end of the detonator opposite the percussion-actuation end. The booster includes a booster housing 23 within which is retained a quantity of explosive material 17. Typically, but not necessarily, the explosive material 17 may be in solid or semi-solid form and shaped to allow the detonator to be seated therein, such that the percussion-actuation end of the detonator is embedded in the explosive material. In this way, actuation of the base charge in the detonator may cause subsequent actuation of the explosive material 17 in the booster.

The booster assembly further comprises a connector comprising an attachment cap 24 to which is attached a signal transmission line retainer. In the embodiment illustrated, the signal transmission line retainer takes the form of an orifice through the attachment cap and a seal 25 surrounding the orifice, such that the signal transmission line passes through the orifice and is substantially prevented from sliding through the orifice due to the friction or adhesion on an outer surface of the signal transmission line imparted by seal 25. The seal 25 may be merely defined by the wall of the orifice and/or by a seal material in engagement with the wall. The seal material may be a deformable seal, a bounding material, between the wall and the signal transmission line or in situ bonding between the wall and the signal transmission line. The connector may be attached to the booster via the attachment cap, and any form of engagement at the interface between the connector and the booster housing may be used to achieve attachment. For example, the attachment may involve a latch, lipped or stepped portion of both the connector and the booster housing. Alternatively, the attachment may involve a screw thread connection or friction fit. In any event, the interface between the attachment cap 24 and the booster housing 23 preferably includes seal 26 to further help prevent ingress of water or dirt into the assembled booster assembly. The seal 26 may take any form including precision fit of the connector to the booster housing, a deformable member such as an O-ring, or a friction fit.

Example 2

Figure 2:
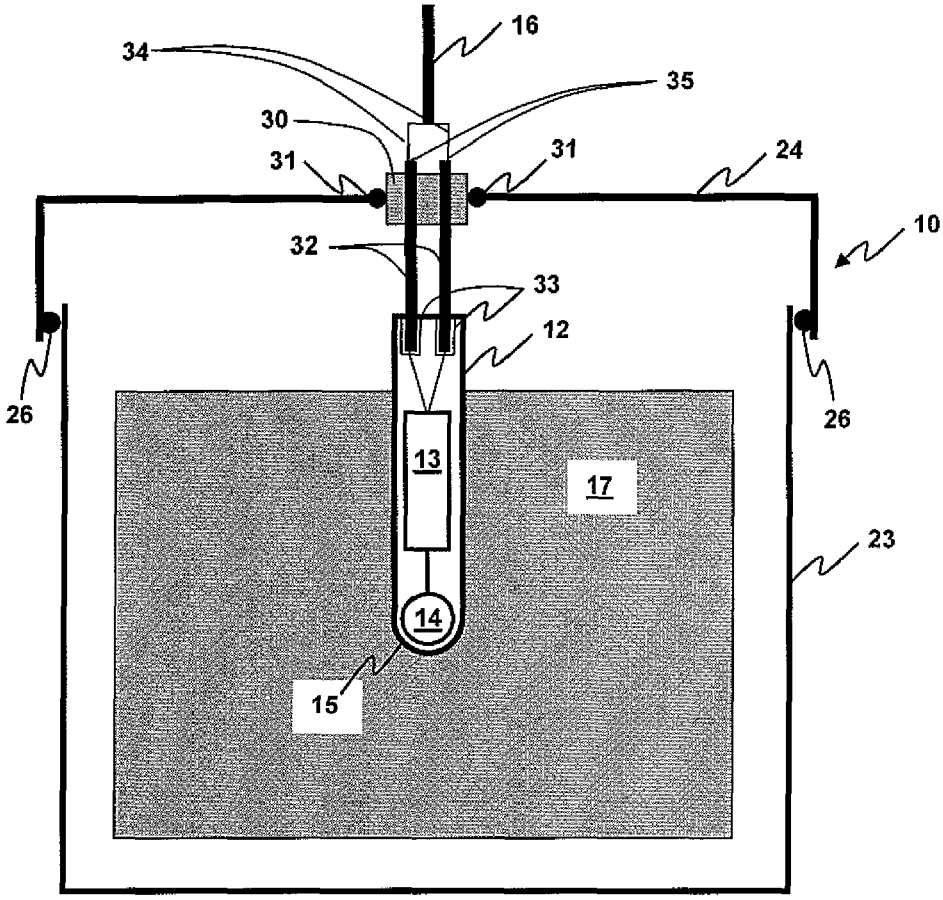
FIG. 2 schematically illustrates a preferred booster assembly of the invention, comprising a preferred connector of the invention in cross-section.

Booster Assembly Comprising Connector, with Signal Transmission Line Connected to Electrically Conductive Bridge Elements Turning now to FIG. 2, the embodiment illustrated is similar to that described in Example 1, with the exception that the signal transmission line retainer comprises electrically conducting bridge elements 32, extending through an optionally reinforced section 30 of attachment cap 24. Wires 34 of signal transmission line 16 are attached at interface 35 (e.g. a wire clasp or crimp) to the electrically conductive bridge elements 32. The bridge elements effectively form pins positioned to extend towards the detonator 12, to be received by sockets 33 in the detonator when the attachment cap 24 is properly attached to the booster housing 23. In this way, the bridge elements effectively "plug into" the detonator, thereby to provide electrical contact from the signal transmission line and the detonator. Preferably, attachment of the attachment cap to the housing helps to align the bridge elements 31 with the sockets in the detonator. Moreover, the detonator has no trailing wires, and may be transmitted to the blast site independently from the signal transmission line. Optionally, the connector may be factory assembled and transported with a signal transmission line already attached. This connector/signal transmission line combination would not include any explosive materials, and therefore may be shipped without special consideration for explosives. Indeed the booster (containing explosive material), the detonator, and the connection (optionally with the signal transmission line attached) may all be shipped independently to the blast site from separate manufacturing locations.

Seals 26 and 31 may, as previously described, help prevent ingress of water or dirt into the booster assembly following assembly at the blast site.

Although only two bridge elements are illustrated in FIG. 2, any number of bridge elements may be present as required by the booster assembly.

Example 3

Figure 3:
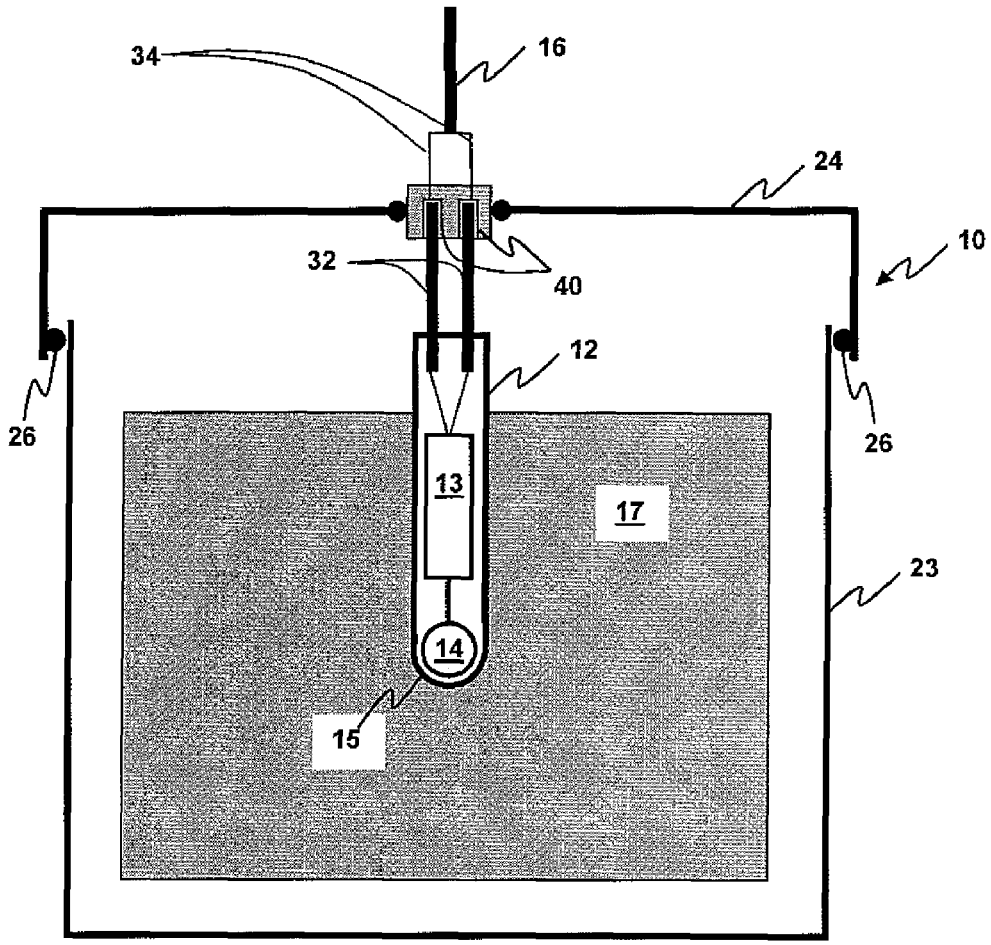
FIG. 3 schematically illustrates a preferred booster assembly of the invention, comprising a preferred connector of the invention in cross-section.

Booster Assembly Comprising Connector, with Detonator Comprising Electrically Conductive Bridge Elements Turning now to FIG. 3, there is shown a further embodiment of the booster assembly of the present invention. This booster assembly is similar to that described in Example 2, except that in this embodiment the electrically conductive bridge elements 32 form part of and extend from the detonator shell 12. In this way, the bridge elements 32 are received by sockets 40 forming part of the attachment cap 24, or optionally a reinforced portion 30 thereof. The sockets are in electrical contact with the wires 34 extending from signal transmission line 16, such that electrical contact is established between the signal transmission line and the detonator when the pins 32 are located therein. In accordance with Example 2, the detonator includes no trailing wires and may be transported to the blast site independently from the signal transmission line. Optionally, the connector may be factory assembled and transported with a signal transmission line already attached. This connector/signal transmission line combination would not include any explosive materials, and therefore may be shipped without special consideration for explosives. Indeed the booster (containing explosive material), the detonator, and the connector (optionally with the signal transmission line attached) may all be shipped independently to the blast site from separate manufacturing locations.

Example 4

Figure 4:
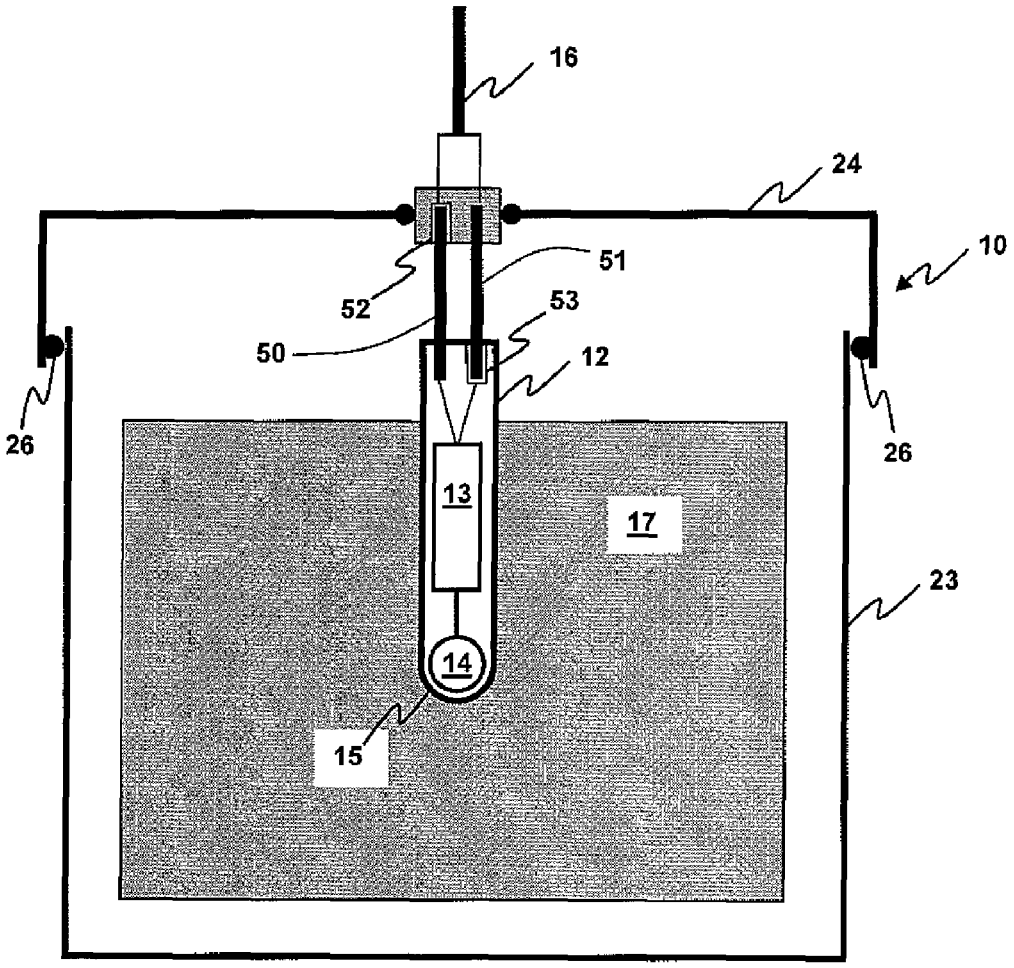
FIG. 4 schematically illustrates a preferred booster assembly of the invention, comprising a preferred connector of the invention in cross-section.

Booster Assembly Comprising Connector, with Detonator and Connector Each Comprising Electrically Conductive Bridge Elements Turning now to FIG. 4, there is shown a further embodiment of the booster assembly of the present invention. This booster assembly is similar to that described in Example 2 or 3, except that in this embodiment one electrically conductive bridge element 50 forms part of and extends from the detonator 12, and another electrically conductive bridge element 51 forms part of and extends from the attachment cap 24. In this way, bridge element 50 is received by socket 52 forming part of the attachment cap 24, or optionally a reinforced portion 30 thereof. Moreover, bridge element 51 is received by socket 53 forming part of the detonator. In this way, the detonator may include at least one pin (only one is shown in FIG. 4), and likewise the retainer of the connector may include at least one pin (only one is shown in FIG. 4). Under specific circumstances, this configuration may assist in ensuring proper mating of pins and sockets upon attachment of the connector onto the booster housing, thereby improving the security and reliability of the signal transmission line to detonator connection.

Example 5

Booster Assembly Including Connector Comprising Detonator Clamp or Clasp

Figure 5:
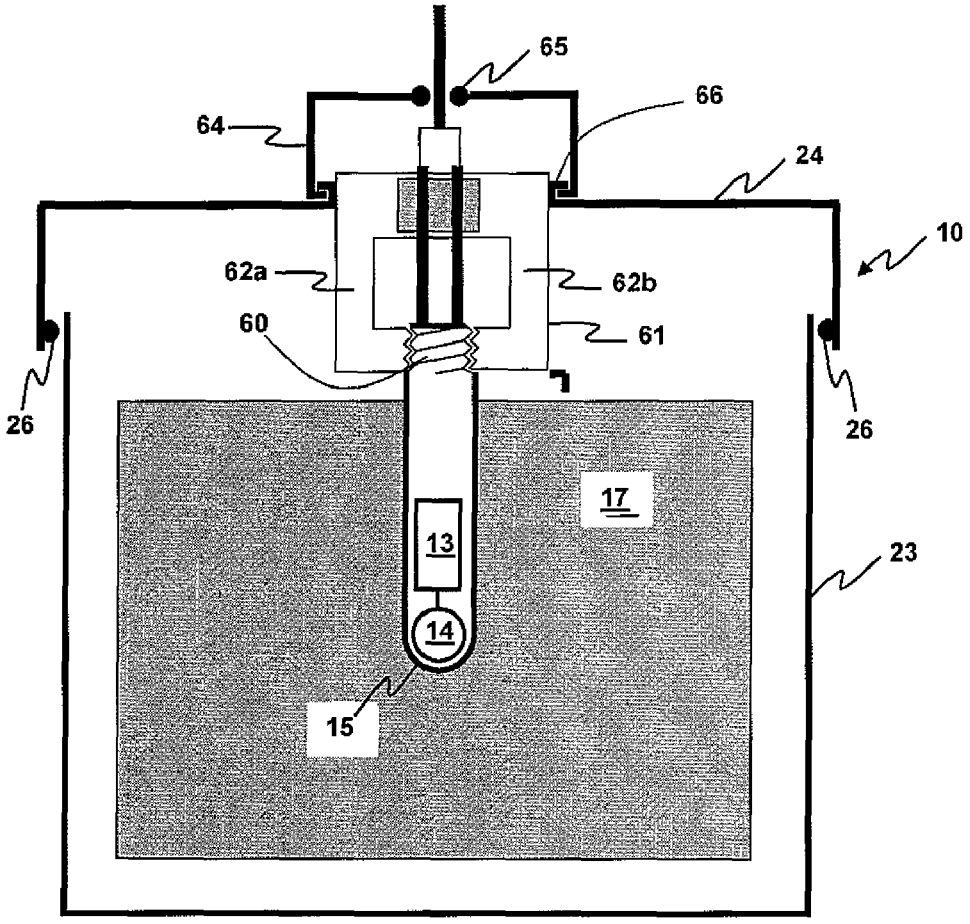
FIG. 5 schematically illustrates a preferred booster assembly of the invention, comprising a preferred connector of the invention in cross-section.

Turning now to FIG. 5, a further booster assembly is illustrated, in which the detonator is secured in position within the booster through interaction with components of the connector. In this regard, the connector or retainer includes a detonator clamp 61 that is integral with or otherwise sealing secured to the attachment cap 24. The clamp includes arms 62*a* and 62*b* that extend from the attachment cap towards the detonator and terminate in clamp portions adapted to clamp the detonator in position. In the embodiment illustrated, the detonator includes a threaded end portion 60 at an end opposite the percussion-actuation end. The ends of arms 62*a* and 62*b* are shaped and adapted to engage the threaded portion 60, thereby to hold and secure the detonator at the desired position in the booster. Alternatively, the clamp 61 may comprise a block, including a hollow block, having a screw-threaded opening at its lower end (in FIG. 5) to receive the detonator portion 60. FIG. 5 shows such a block in section. The connector may comprise such a detonator clamp in combination with any form of signal transmission line retainer as described, although electrically conductive bridge elements are illustrated in FIG. 5.

Another preferred feature of the connector of the invention is also shown in FIG. 5. This pertains to the closure cap 64, which extends about the signal transmission line 16 via seal 65. The closure cap 64 is further affixed to the attachment cap via lip 66, although any form of attachment may be used, including a screw-threaded arrangement, or adhesive. The closure cap 64 serves to provide added sealing and/or protection to the connector at or near the signal transmission line retainer extending through the attachment cap 24. For example, in FIG. 5 the embodiment illustrated includes a closure cap 64, which helps to cover and protect (e.g. from shock, water ingress or dirt ingress) the wires 34 extending from the signal transmission line 16, as well as the interfaces 35 of the wires with the portions of the electrically conductive bridge elements extending from the connector.

Example 6

Figure 6:
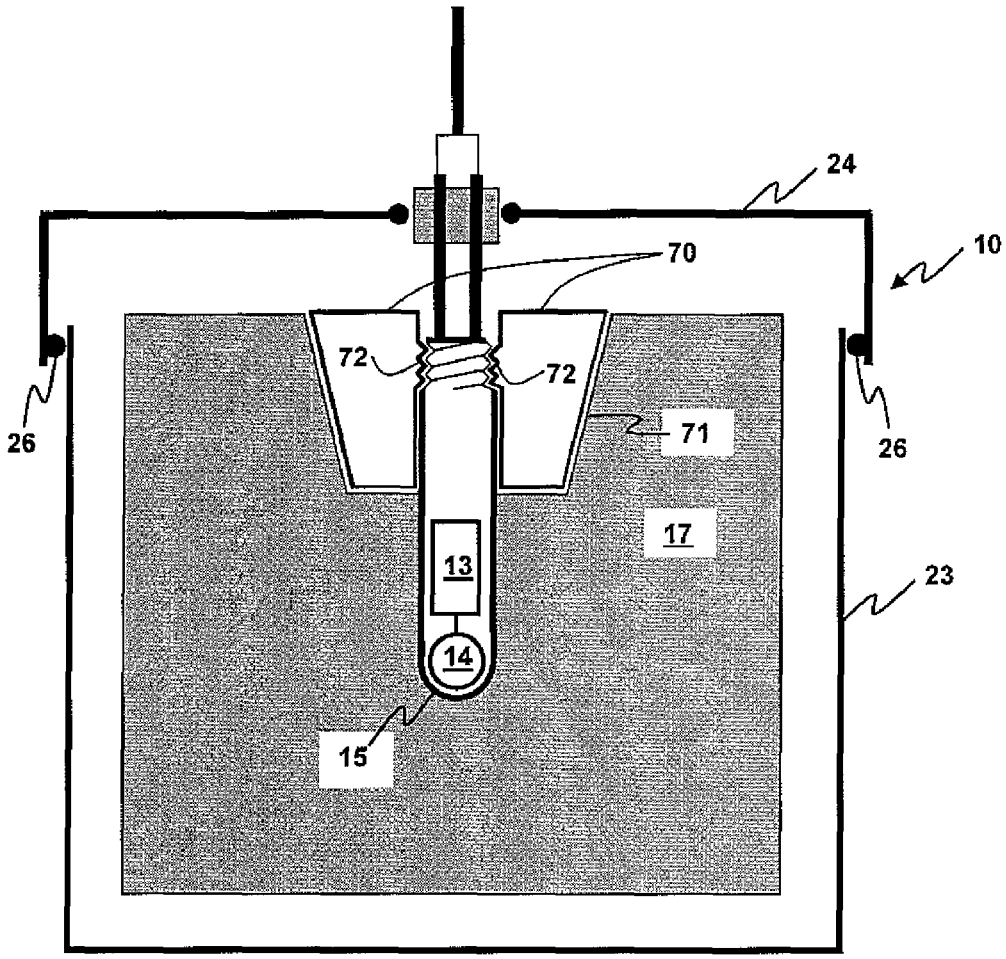
FIG. 6 schematically illustrates a preferred booster assembly of the invention, comprising a preferred connector of the invention in cross-section.

Booster Assembly Including Connector Comprising Positioning Element to Assist in Detonator Seating in the Booster Yet another preferred feature of the invention is illustrated in FIG. 6. In this embodiment there is included a positioning element 70 to assist in detonator seating and positioning in recess 71 of the booster, thereby helping to bring percussion-actuation end 15 of the detonator into a position suitable for actuation of the explosive charge in the booster. The positioning element shown has a frusto-conical configuration, but in other embodiments may take any form suitable for engaging the detonator in some way, and seating the detonator into a recess in the explosive charge. For example, in contrast to the frusto-conical positioning element shown, the use of a positioning element that does not have a circular cross-section may be preferred in selected embodiment to prevent rotation of the positioning element during assembly and/or use of the booster assembly. In the embodiment illustrated, the positioning element further includes a detonator engagement portion 72, which helps to grip the detonator typically at an end opposite the percussion-actuation end. In the embodiment illustrated in FIG. 6, the detonator includes a threaded portion 60 in the same manner as the embodiment illustrated in FIG. 5, and the detonator engagement portion 72 of the positioning element 70 holds the detonator in position by engaging the threaded portion of the detonator.

Example 7

Preferred Pin or Socket Configurations, and Detonators of the Present Invention

In any of the Examples 2, 3, and 4, which involve the use of a component having a socket connection, each socket may optionally include a frangible web to 'seal' the socket prior to use. For example, the socket may include a thin layer of electrically insulative material extending across an open end of the socket, such that the first time a corresponding pin from another component of the booster assembly is inserted into the socket, the frangible web is perforated thereby permitting electrical contact to be established between the pin, and electrically conductive inner portions of the socket away from the perforated frangible web. The frangible web, at least in preferred embodiments, may improve the robustness of the socket and help prevent ingress into the socket of water or dirt prior to use of the component.

Moreover, in any embodiments that involve the use of a pin-like connector, the pin may be covered in a removable layer of electrically insulative material prior to use, such that upon assembly of the booster assembly for example at the blast site, the removable layer is removed to reveal the electrically conductive pin.

In other aspects of the invention there are provided detonators comprising at least one pin, and/or at least one socket as previously described. In this way, the detonators of the invention are independent units that may be manufactured and shipped to a blast site without trailing wires or other components attached thereto. In this way, the invention provides for detonators that are easily connectible to other components at the blast site, without the need for specialist tools or knowledge to "tie-in" the detonators, or crimp, clasp or solder wires or connections at the blast site. Preferably, the detonators may include at least one socket comprising a frangible web, and/or at least one pin comprising a removable layer as previously described. In this way, the detonator may be substantially sealed from ingress of water or dirt during transportation, storage, or prior to use at the blast site. Moreover, the pins and/or sockets may be protected from damage during transport or manhandling of the detonators, and concealment of the electrical contacts prior to set-up of the blasting apparatus may present further safety advantages.

Example 8

Methods of the Invention

Figure 7:
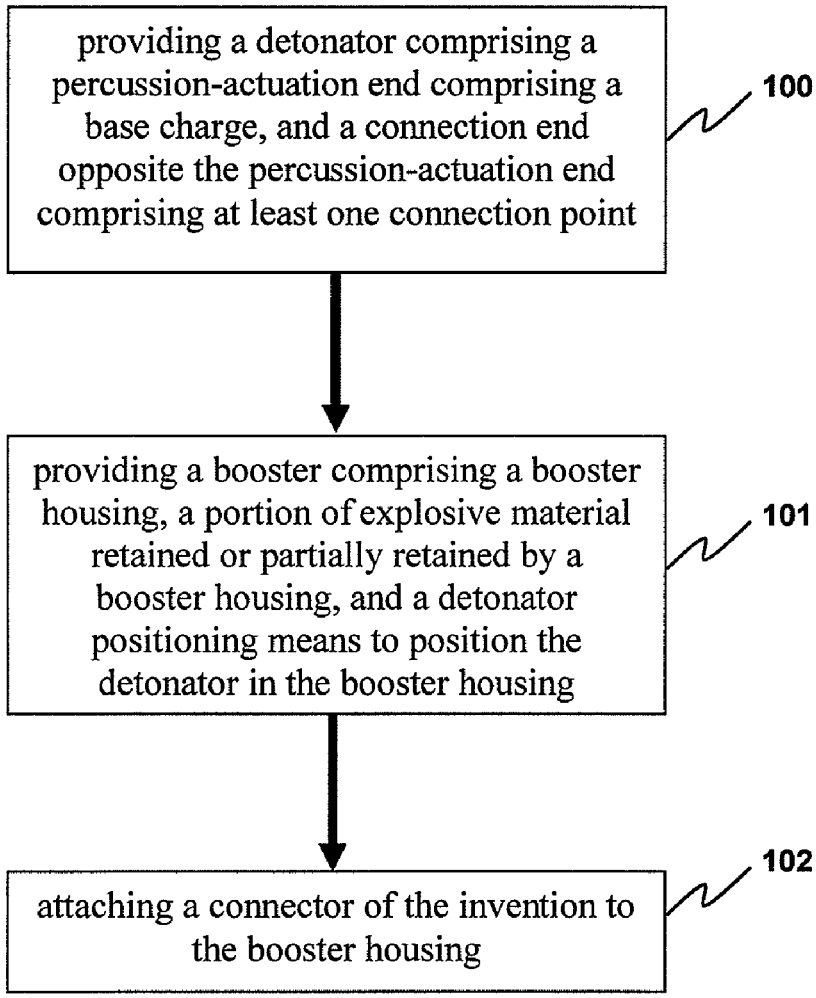
FIG. 7 illustrates a preferred method of the invention for producing a booster assembly of the invention.

Further aspects of the present invention relate to various methods. For example, with reference to FIG. 7, the invention encompasses a method of producing a booster assembly of the invention, comprising:

in step 100 providing a detonator comprising a percussion-actuation end comprising a base charge, and a connection end opposite the percussion-actuation end comprising at least one connection point;

in step 101 providing a booster comprising a booster housing, a portion of explosive material retained or partially retained by a booster housing, and a detonator positioning means to position the detonator in the booster housing such that receipt by the detonator via the signal transmission line of a command signal to FIRE causes initiation of the base charge, and subsequent actuation of the explosive material in the booster; and in step 102 attaching a connector of the invention to the booster housing.

Figure 8:
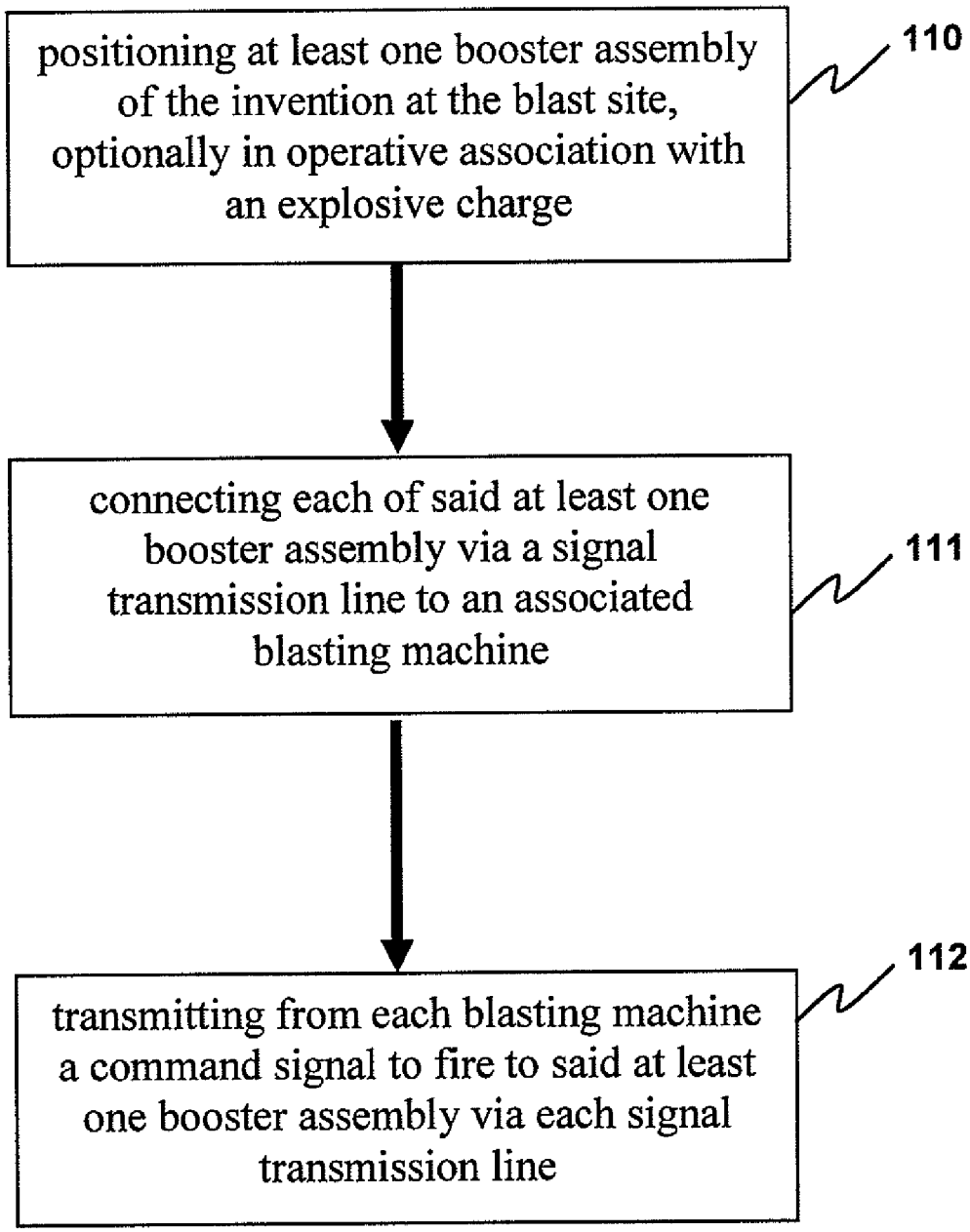
FIG. 8 illustrates a preferred method of the invention for conducting a blasting event.

Another method of the invention will also be appreciated and described with reference to FIG. 8. There is illustrated a method of conducting a blasting event at a blast site, comprising:

in step 110 positioning at least one booster assembly of the invention at the blast site, optionally in operative association with an explosive charge;

in step 111 connecting each of said at least one booster assembly via a signal transmission line to an associated blasting machine;

in step 112 transmitting from each blasting machine a command signal to fire to said at least one booster assembly via each signal transmission line, thereby to effect actuation of each base charge of each detonator of each booster assembly, thereby to cause actuation of the explosive charge in said booster, and actuation of further explosive material external to the booster, if present.

Example 9

Booster Assembly Comprising a Sensitizing Insert

Figure 9:
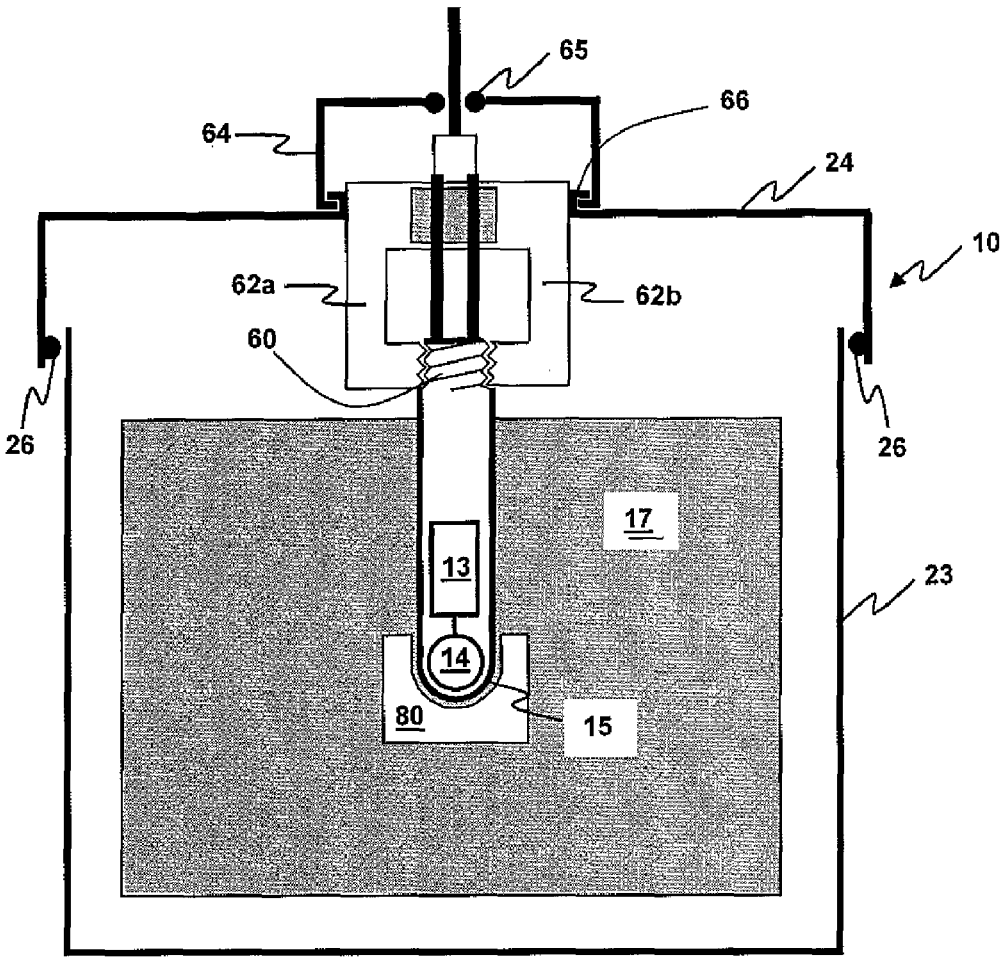
FIG. 9 schematically illustrates a preferred booster assembly of the invention, comprising a preferred connector of the invention in cross-section.

Turning now to FIG. 9, there is illustrated a booster assembly that is similar to that show in FIG. 5, except for the addition of sensitizing insert 80. Although a specific configuration, shape and position of the sensitizing insert is illustrated, any configuration and shape for the sensitizing insert may be used in accordance with any embodiment of the invention. Indeed, the use of a sensitizing insert may be applied to any embodiments of the booster assemblies of the invention, regardless of the configuration of the attachment cap, housing or other components of the assembly.

The purpose of the sensitizing insert is to provide an intermediary explosive charge in between the base charge 14 of the detonator, and the portion of explosive material 17 in the booster housing 23. In this way, actuation of the assembled booster assembly may involve actuation of the base charge of the detonator in response to a command signal to FIRE, thereby causing actuation of the sensitizing insert, which in turn results in actuation of the portion of explosive material in the booster. Optionally, the sensitizing insert may be more sensitive to actuation (upon actuation of the base charge) compared to the portion of explosive material in the booster. In this way, the sensitizing insert forms an intermediary explosive charge between the base charge of the detonator, and the larger explosive charge in the booster. The sensitizing insert may comprise any form of explosive material, including but not limited to lead azide and/or PETN. In preferred embodiments, the sensitizing insert may be suitable for shipment with a corresponding booster (either integrated into the booster for shipment, or packaged separately). The sensitizing insert may allow for the booster assembly, once assembled, to be actuated using a lower power detonator when compared with a booster assembly lacking a sensitizing insert. Further, the use of such lower power detonators may simplify the logistics of detonator transportation, since lower power detonators may be subject to less stringent shipping requirements.

Figure 10:
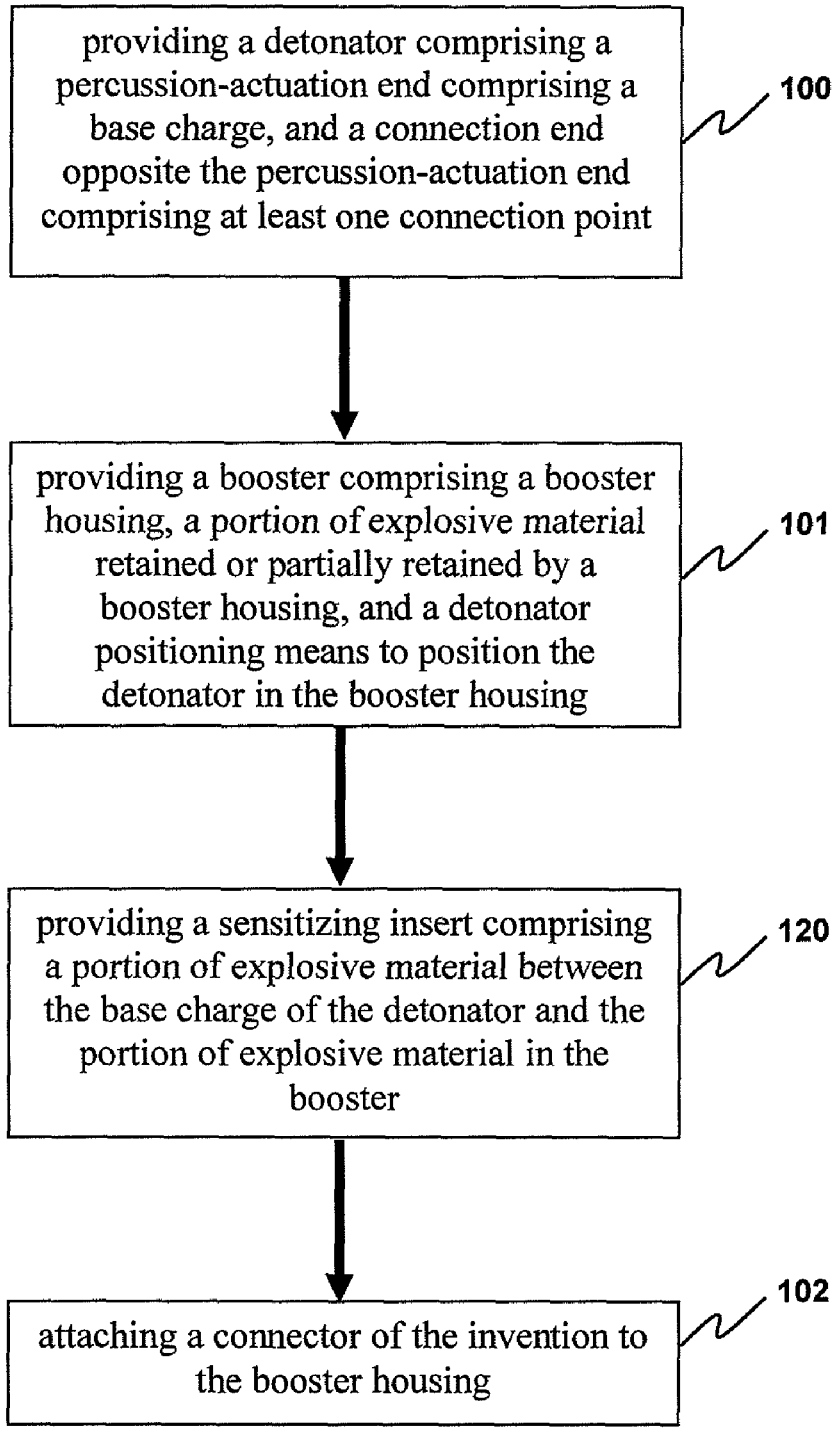
FIG. 10 illustrates a preferred method of the invention for producing a booster assembly of the invention.

FIG. 10 illustrates a corresponding method of producing a booster assembly of the invention. The method is identical to that discussed with reference to FIG. 7, with the exception of additional step 120 of providing a sensitizing insert comprising a portion of explosive material between the base charge of the detonator and the portion of explosive material in the booster. The steps 100, 101 and 120 of the method may be performed in any order, providing that the finally assembled booster assembly permits actuation of the portion of explosive material in the booster housing, via sequential actuation of the detonator base charge and the sensitizing insert, upon receipt by the detonator insert of a command signal to FIRE.

Whilst the invention has been described with reference to specific embodiments of connectors, booster assemblies, detonators, and methods, a person of skill in the art will appreciate that other connectors, booster assemblies, detonators, and methods other than those specifically described will also be encompassed by the present invention. It is the intention to capture all such embodiments within the scope of the appended claims.

The invention claimed is:

1. A booster assembly comprising:

(1) a detonator comprising a percussion-actuation end comprising a base charge, and a connection end opposite the percussion-actuation end comprising at least one connection point;

(2) a booster comprising a booster housing, an explosive charge retained or partially retained by the booster housing, and a detonator positioning means to position the detonator in the booster housing such that receipt by the detonator via a signal transmission line of a command signal to FIRE causes initiation of the base charge, and subsequent actuation of the explosive charge in the booster; and (3) a connector for securing the signal transmission line in electrical connection with the detonator positioned in the booster, the connector comprising:

a) an attachment cap for permanently or selectively sealing the connector to the booster housing; and b) a signal transmission line retainer comprising electrically conductive material for providing electrical contact between said signal transmission line and the at least one connection point of said detonator, said retainer extending through the attachment cap and holding the signal transmission line in secure electrical contact with the at least one connection point of the detonator when the attachment cap is secured to the booster housing, an interface between said retainer and said signal transmission line and/or said attachment cap being at least substantially sealed.

2. The booster assembly of claim 1, wherein the attachment cap comprises a deformable seal at an interface between said booster housing and said connector when said connector is secured to said booster housing to cause frictional engagement to assist in securing said connector to said booster housing and/or to substantially prevent ingress of dirt or water into said housing at said interface.

3. The booster assembly of claim 1, wherein the signal transmission line retainer of the connector comprises at least one electrically conductive element extending through the attachment cap, each comprising a pin or socket member positioned to mate with and form electrical contact with a corresponding pin or socket connection point of the detonator when the attachment cap is secured to the booster housing, each element further including a signal transmission line attachment means on a side of the attachment cap opposite each pin or socket member.

4. The booster assembly of claim 1, wherein the attachment cap or signal transmission line retainer comprises at least one detonator engagement member extending into the booster housing to grip or hold the detonator at or near the connection end when the connector is attached to the booster, thereby to assist in securing of said detonator within said booster and positioning of said detonator for secure electrical contact with said signal transmission line.

5. The booster assembly of claim 1, further comprising a sensitizing insert comprising a discrete portion of explosive material, and positioned within the booster housing near or adjacent the base charge of the detonator, whereby actuation of the base charge of the detonator in response to a command signal to FIRE causes subsequent actuation of said sensitizing insert, which causes subsequent actuation of the explosive material of the booster.

6. The booster assembly of claim 5, wherein the sensitizing insert comprises PETN and/or lead azide.

7. The booster assembly of claim 5, wherein the detonator is a low power detonator.

8. A blasting apparatus for conducting a blasting event at a blast site, the blasting apparatus comprising;

at least one blasting machine for generating command signals;

at least one booster assembly of claim 1 in signal communication with said at least one blasting machine via a signal transmission line.

9. A booster connector for use in an assembly comprising the connector, a detonator and a booster, said connector being provided to secure a signal transmission line in electrical connection with the detonator positioned in the booster, the detonator having a percussion-actuation end comprising a base charge, and a connection end opposite the percussion-actuation end comprising at least one connection point, the booster comprising a booster housing, an explosive charge retained or partially retained by the booster housing, and a detonator positioning means to position the detonator in the booster housing such that receipt by the detonator via the signal transmission line of a command signal to FIRE causes initiation of the base charge, and subsequent actuation of the explosive charge in the booster, wherein the connector comprises:

an attachment cap for permanently or selectively sealing the connector to the booster housing; and a signal transmission line retainer comprising electrically conductive material for providing electrical contact between said signal transmission line and the at least one connection point of said detonator, said retainer extending through the attachment cap for holding the signal transmission line in secure electrical contact with the at least one connection point of the detonator when the attachment cap is secured to the booster housing, an interface between said retainer and said attachment cap being at least substantially sealed.

10. The connector of claim 9, wherein the attachment cap comprises a deformable seal at an interface between said booster housing and said connector when said connector is secured to said housing to cause frictional engagement to assist in securing said connector to said booster housing and/or to substantially prevent ingress of dirt or water into said housing at said interface.

11. The connector of claim 9, wherein the signal transmission line retainer comprises at least one electrically conductive element extending through the attachment cap, each comprising a pin or socket member positioned to mate with and form electrical contact with a corresponding pin or socket connection point of the detonator when the attachment cap is secured to the booster housing, each element further including a signal transmission line attachment means on a side of the attachment cap opposite each pin or socket member.

12. The connector of claim 11, wherein prior to use each socket member is covered by a frangible web of electrically insulating material that during use is perforated by inserting a pin of another component of the assembly, and/or wherein prior to use each pin is covered by a removable layer of electrically insulating material that is removed prior to insertion of the pin into a socket of another component of the assembly.

13. The connector of claim 9, wherein the attachment cap or signal transmission line retainer comprises at least one detonator engagement member extending into the booster housing when the attachment cap is secured to the booster housing to grip or hold the detonator at or near the connection end, thereby to assist in securing of said detonator within said booster and positioning of said detonator for secure electrical contact with said signal transmission line.

* * * * *